US008215732B2

(12) United States Patent
Kim

(10) Patent No.: US 8,215,732 B2
(45) Date of Patent: Jul. 10, 2012

(54) VERTICALLY ADJUSTABLE REFRIGERATOR SHELF WITH HIDDEN DRIVE UNIT

(75) Inventor: Hyeon Jin Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 266 days.

(21) Appl. No.: 12/634,370

(22) Filed: Dec. 9, 2009

(65) Prior Publication Data

US 2010/0176703 A1 Jul. 15, 2010

Related U.S. Application Data

(60) Provisional application No. 61/145,043, filed on Jan. 15, 2009.

(51) Int. Cl.

| | |
|---|---|
| ***A47H 1/00*** | (2006.01) |
| ***A47B 43/00*** | (2006.01) |
| ***A47B 47/00*** | (2006.01) |
| ***A47B 57/00*** | (2006.01) |
| ***A47B 96/04*** | (2006.01) |
| ***A47B 95/02*** | (2006.01) |
| ***A47B 85/00*** | (2006.01) |

(52) U.S. Cl. ..... 312/408; 211/103; 211/193; 312/319.5; 108/20

(58) Field of Classification Search ..... 312/408, 312/319.5–319.8, 351, 404; 108/147.11, 108/147.17, 108, 20; 211/1.51, 1.57, 103, 211/187, 193, 207, 208, 190, 209
See application file for complete search history.

(56) References Cited

U.S. PATENT DOCUMENTS

| | | | | |
|---|---|---|---|---|
| 355,856 | A * | 1/1887 | Bayer | 248/522 |
| 3,982,801 | A * | 9/1976 | Heidorn et al. | 312/306 |
| 5,199,778 | A * | 4/1993 | Aoki et al. | 312/408 |
| 5,913,584 | A * | 6/1999 | Swindell et al. | 312/408 |
| 6,065,821 | A * | 5/2000 | Anderson et al. | 312/408 |
| 6,813,896 | B1 * | 11/2004 | Janke et al. | 62/126 |
| 7,806,490 | B1 * | 10/2010 | Buehl | 312/312 |
| 2002/0124777 | A1 * | 9/2002 | Lag | 108/20 |
| 2004/0255607 | A1 * | 12/2004 | Barmann et al. | 62/407 |
| 2007/0046160 | A1 * | 3/2007 | Egan | 312/408 |
| 2007/0156261 | A1 * | 7/2007 | Caldwell et al. | 700/60 |
| 2008/0246382 | A1 * | 10/2008 | Kang et al. | 312/408 |

* cited by examiner

*Primary Examiner* — Darnell Jayne
*Assistant Examiner* — Andrew Roersma
(74) *Attorney, Agent, or Firm* — Birch, Stewart, Kolasch & Birch, LLP.

(57) ABSTRACT

Provided are a refrigerator and a refrigerator shelf apparatus configured with a shelf detachably mounted to a drive unit, and the drive unit capable of driving the shelf upward and downward according to electronic controlling by a controller provided on the shelf.

9 Claims, 7 Drawing Sheets

VERTICALLY ADJUSTABLE REFRIGERATOR SHELF WITH HIDDEN DRIVE UNIT

This Nonprovisional application claims priority under 35 U.S.C. §119(e) on U.S. Provisional Application No. 61/145,043 filed on Jan. 15, 2009, the entire contents of which are hereby incorporated by reference.

THE BACKGROUND

1. The Field

The present invention relates to a refrigerator and a refrigerator shelf apparatus capable of adjusting the height of a shelf.

2. Description of the Related Art

In general, a refrigerator is a household appliance for storing food at low temperatures over extended periods.

Specifically, depending on the locations of their refrigeration compartments and freezer compartments, refrigerators can be categorized into top mount refrigerators having the freezer compartment provided at the top, bottom freezer refrigerators having the freezer compartment provided at the bottom, and side by side refrigerators having the refrigeration compartment and freezer compartment arranged to the left and right of each other.

Also, a plurality of shelves on which food is placed, and box-shaped drawers open at the top for storing vegetables or fruit may be provided inside a refrigerator. The shelves and drawers are configured to partition the space inside the refrigerator for efficient storage of food, and the shelves in particular are configured to be selectively removable from within the refrigerator.

Furthermore, refrigerators are currently being developed to have structures that enable efficient utilization of refrigerator space through height adjustment of mounted shelves.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
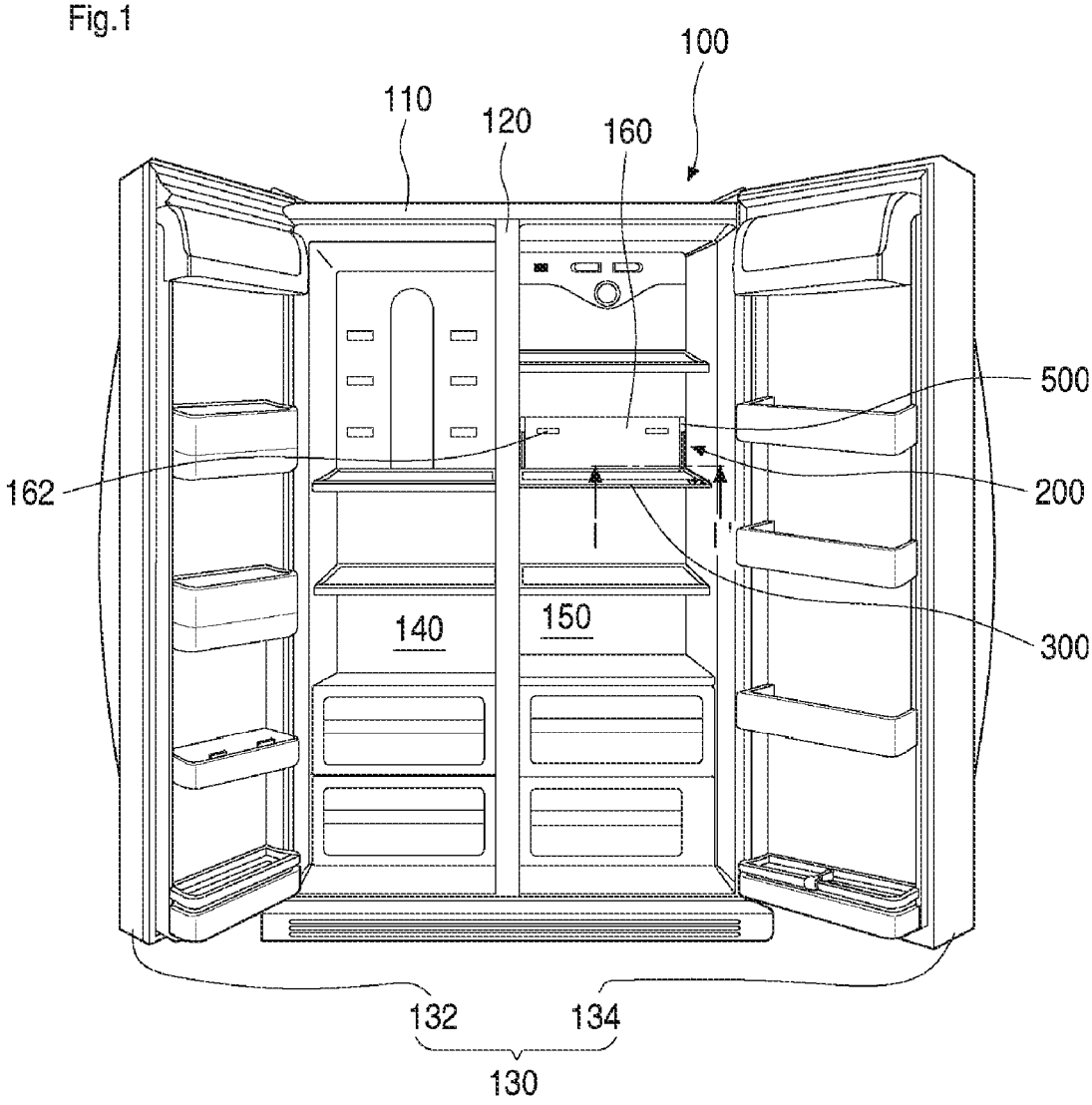
FIG. 1 is a frontal view of a refrigerator with doors open according to a first embodiment of the present invention.

FIG. 1 is a frontal view of a refrigerator with doors open according to a first embodiment of the present invention.

Referring to FIG. 1, a refrigerator 100 according to the first embodiment of the present invention is configured with a body 110 defining a storage space, and a door 130 opening and closing the open front of the body 110. The body 110 defines a freezer compartment 140 and a refrigerator compartment 150 to the left and right, respectively, by means of a barrier 120, and the door 130 is configured as a freezer compartment door 132 and a refrigeration compartment door 134 that open and close the freezer compartment 140 and the refrigeration compartment 150, respectively.

A plurality of storage members such as shelves, drawers, and baskets are provided within the freezer compartment 140 and refrigeration compartment 150 and at the rear of the doors 130 to store food. Of these, the shelves and baskets are provided to be selectively detached and attached by a user.

At least one or more shelves are arranged vertically in the freezer compartment 140 and refrigeration compartment 150, and at least one of a plurality of shelves (being a component of a shelf apparatus) is provided to be movable upward and downward.

Figure 2:
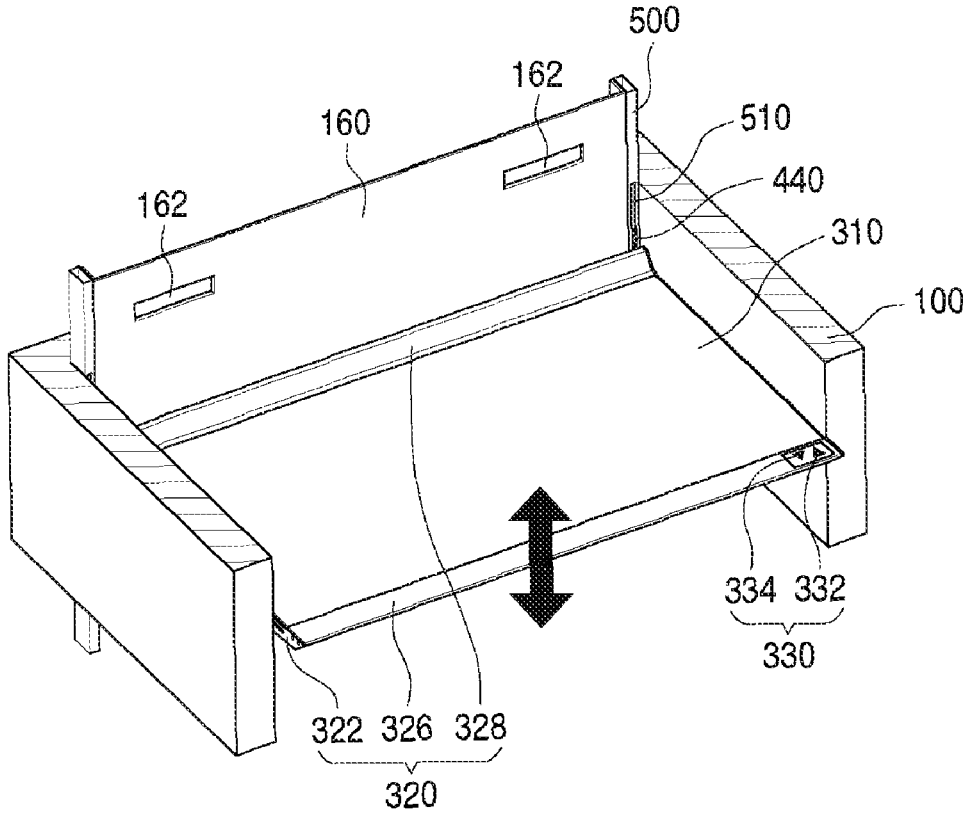
FIG. 2 is a perspective view of a refrigerator shelf apparatus according to the first embodiment of the present invention.
Figure 3:
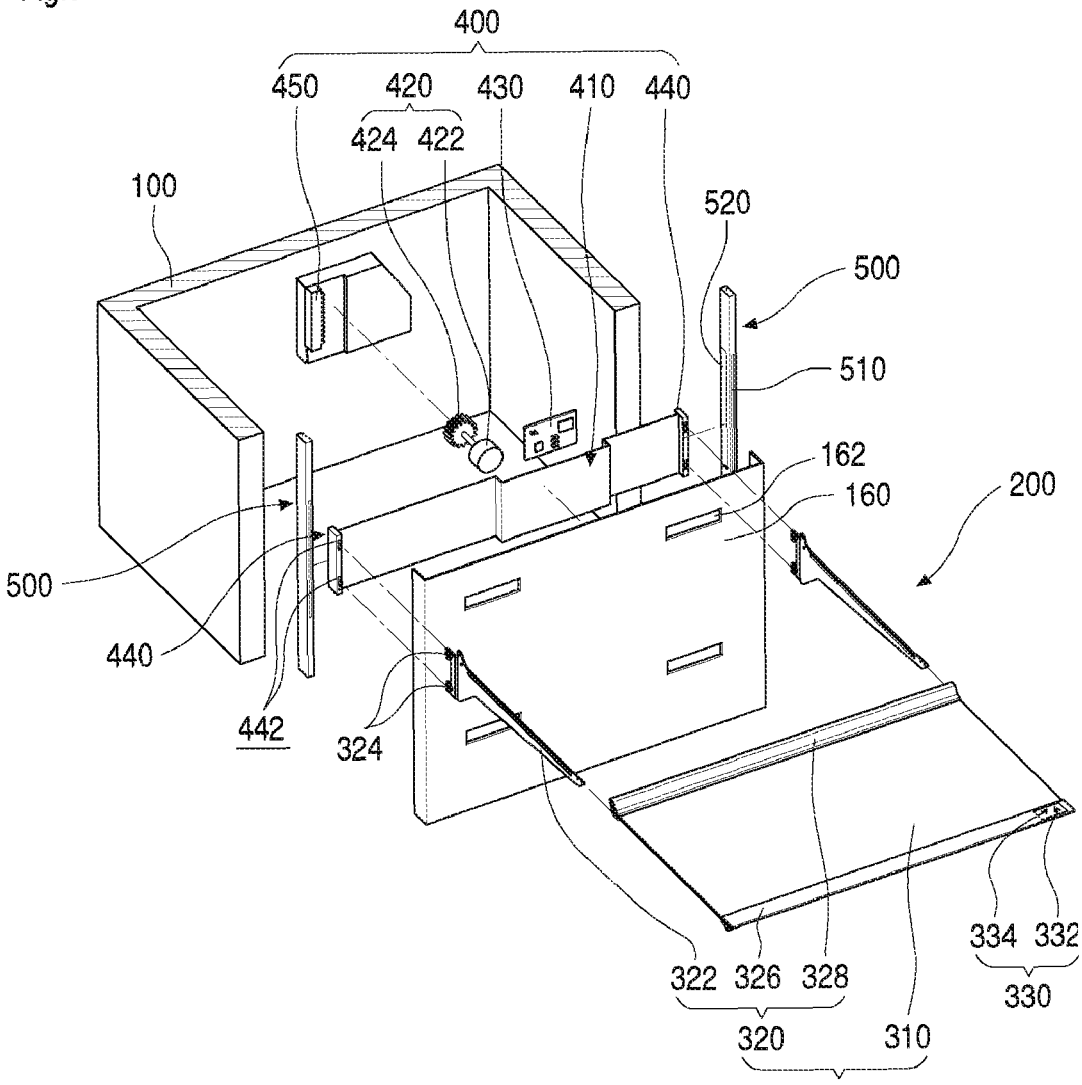
FIG. 3 is an exploded perspective view of a refrigerator shelf apparatus according to the first embodiment of the present invention.

FIG. 2 is a perspective view of a refrigerator shelf apparatus according to the first embodiment of the present invention, and FIG. 3 is an exploded perspective view of a refrigerator shelf apparatus according to the first embodiment of the present invention.

Referring to FIGS. 2 and 3, with respect to the shelf apparatus 200, in order to move a mounted shelf 300 upward and downward, the shelf apparatus 200 is configured to include a shelf 300 on which food is placed, a drive unit 400 coupled to the shelf 300 to provide motive force for moving the shelf 300, a drive rack 450 enabling the drive unit 400 to move upward and downward, and a guide member 500 for guiding the movement of the drive unit 400.

The shelf 300 is formed in an approximately rectangular shape and of a corresponding size that enables it to horizontally partition the space within the refrigeration compartment 150 or the freezer compartment 140. Also, the shelf 300 is formed of a plate 310 made of tempered glass, and a frame 320 forming the perimeter of the plate 310 and fixable to the shelf drive unit 400.

The frame 320 may be formed through insert-molding around the perimeter of the plate 310, and is configured with a front frame 326 forming a portion of the front of the plate 310, a rear frame 328, and supporting portions 322 for supporting the plate 310, as shown, and these components in plurality may be coupled and fixed to the plate 310.

The supporting portions 322 are formed at both the left and right sides of the frame 320. The supporting portions 322 are to enable the shelf 300 to be mounted and supported, and are formed with a vertical width that gradually increases from front to rear. Also, a catch portion 324 is formed at the rear of the supporting portion 322.

The catch portion 324 is formed to be bent downward in a hook shape, and is formed at the top and bottom, respectively, on the rear of the supporting portion 322. Also, the catch portion 324 is made to insert in a retaining hole 442 (to be described below) in order to fix and mount the shelf 300. Here, the shelf 300 is fixed in cantilevered fashion through the retaining holes 442 provided in a pair, respectively, at the left and right, and can be securely supported at four points.

A controller 330 is provided at a front edge portion of the shelf 300. The controller 330 is for controlling the driving of the shelf 200, and is configured in button format. Specifically, the controller 330 is provided on the top surface of the frame 320 forming the front end of the shelf 300, and is mounted on the right corner at the front. Also, an up button 332 and a down button 334 for the shelf 300 are provided to move the shelf 300 upward and downward.

The controller 330 may be formed on the plate 310, or may be formed on the front frame 328, as required.

A grille pan 160 is provided behind the refrigeration compartment 150 or the freezer compartment 140. The grille pan 160 partitions the space in the refrigeration compartment 150 or the freezer compartment 140 to define a space in front to store food, and define a space behind in which cold air is circulated. Also, the grille pan 160 may define cold air outlets 162 through which cold air is discharged forward.

The drive rack 450 is provided behind the grille pan 160. The drive rack 450 is for moving the drive unit 400 upward and downward by means of an assembly with a pinion 424 and gear (to be described below), and is provided at the approximate center on the wall inside the refrigerator.

The drive unit 400 is for providing driving force to move the shelf 300 upward and downward, is provided behind the grille pan 160, and is formed corresponding in length to that across the grille pan 160. Also, the drive unit 400 is configured to include a mounting plate 410, a motor assembly 420, and a printed circuit board (PCB) 430.

The mounting plate 410 is formed elongated across, and has a predetermined vertical width to enable the motor assembly 420 and the PCB 430 to be mounted. Also, a shelf mounting portion 440 is formed at the left and right of the mounting frame 410.

The shelf mounting portion 440 is for mounting the shelf 300, and is formed vertically elongated to be capable of vertical movement within the guide member 500. Also, the retaining hole 442 is defined in the front of the shelf mounting portion 440 so that the catch portion 324 of the shelf 300 inserts therein. The retaining hole 442 is defined open in a corresponding size to enable the catch portion 324 to insert therein, and two each are defined in both the left and right sides.

Further, the approximate central portion of the mounting plate 410 is recessed to provide a space in which to mount the motor assembly 420, and the PCB 430 for controlling the motor assembly 420. The motor assembly 420 is driven to move the drive unit 400, and is configured with a drive motor 422 that selectively rotates forward or in reverse according to supplied electrical power, and a pinion 424 mounted on the rotating shaft of the drive motor 422.

The drive motor 422 is fixed and mounted at the approximate center of the mounting plate 410, the pinion 424 is disposed so that it can be coupled to the drive rack 450, and according to requirements, a fixing member such as a bracket may be used to integrally couple the mounting plate 410.

A guide member 500 is provided at both left and right sides of the grille pan 160. The guide member 500 is formed vertically elongated to be capable of guiding vertical movement of the drive unit 400.

The guide member 500 is provided in a space between the side of the grille pan 160 and a sidewall inside the refrigerator, and contacts the side surface of the grille pan 160 and the sidewall within the refrigerator. Also, the front surface of the guide member 500 is formed to be positioned on the same plane as the front surface of the grille pan 160, so that the guide member 500 does not project forward from the grille pan 160.

In detail, in order for the guide member 500 to receive the mounting portion 440 within, it is formed hollow with a cross-sectional size corresponding to the cross-section of the mounting portion 440, and defines a first slot 510 and a second slot 520 to enable vertical movement of the drive unit 400 and the shelf 300, with the mounting portion 440 received therein.

In further detail, the first slot 510 is defined in a side surface of the guide member 500 toward the inside of the refrigerator. Also, the first slot 510 is formed of a size allowing the mounting portion 440 to be inserted, and is formed of a length corresponding to the vertical range of movement of the drive unit 400.

The second slot 520 is defined open in the front surface of the guide member 500 in a size enabling the catch portion 324 of the shelf 300 to be inserted therein. Also, the second slot 520 may be formed of a length corresponding to the length of the first slot 510.

Figure 4:
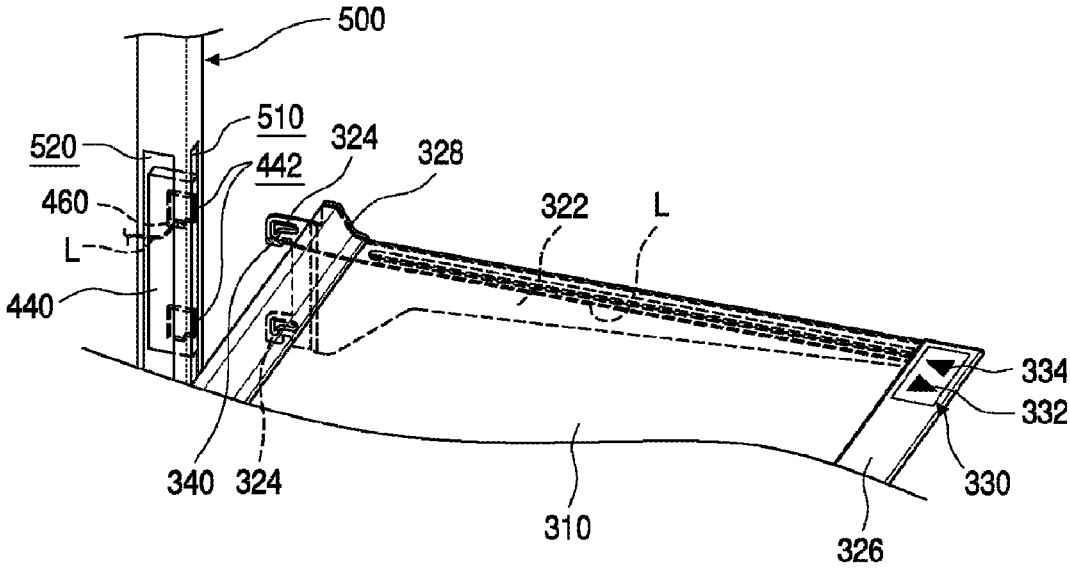
FIG. 4 is a perspective view of a shelf and mounting member according to the first embodiment of the present invention.
Figure 5:
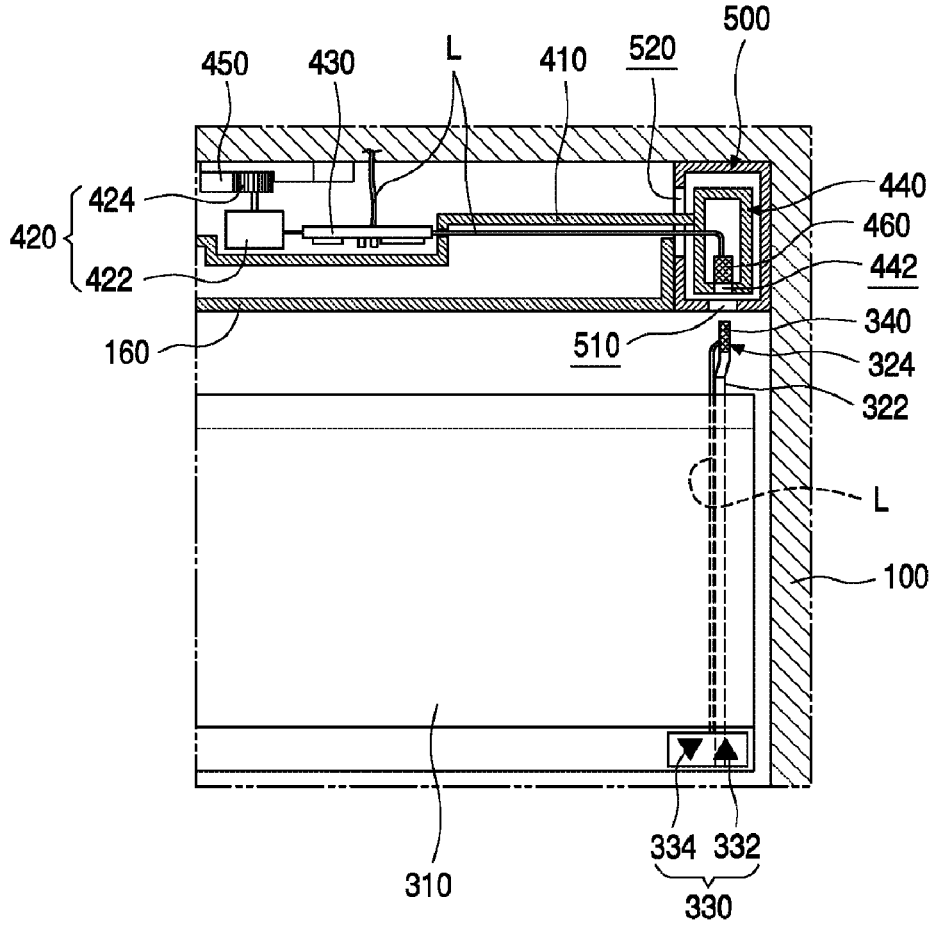
FIG. 5 is a partial sectional view of a refrigerator shelf apparatus according to the first embodiment of the present invention.

FIG. 4 is a perspective view of a shelf and mounting member according to the first embodiment of the present invention, and FIG. 5 is a partial sectional view of a refrigerator shelf apparatus according to the first embodiment of the present invention, taken along section I-I' in FIG. 1.

Referring to FIGS. 4 and 5, the size and shape of the inner cross-sectional area of the guide member 500 are formed corresponding to the size and shape of the cross-section of the mounting portion 440, so that the mounting portion can be received within the guide member 500. Also, the mounting member is formed with a vertical length enabling all the catch portions of the frame to be mounted.

Further, the mounting portion 440 is configured to be movable upward and downward while guided by the guide member 500, and for ease of movement, at least one of the mounting portion 440 and the guide member 500 is formed of a plastic material, and the other is formed of a steel material. For example, the mounting portion 440 may be formed of plastic material, and here, the material used may be an engineering plastic such as polyoxymethylene (POM) with high durability and wear resistance and good lubricative properties.

A shelf power terminal 340 is provided at the end of the catch portion 324 of the frame 320, and a drive unit power terminal 460 is provided in the mounting portion 440 to contact the catch portion 324 when the shelf 300 is mounted.

Here, the shelf power terminal 340 is formed at the rear of the frame 320 at the side (of the left and right sides of the frame 320) at which the controller 330 is disposed. Specifically, the controller 330 and the shelf power terminal 340 are made to be connectable with the shortest power line (L) length possible. Also, the drive unit power terminal 460 is formed within the retaining hole 442 of the mounting portion 440 defined in the side surface corresponding to the shelf power terminal 340.

The shelf power terminal 340 is connected to the controller 330 provided at the front portion of the shelf 300, and the drive unit power terminal 460 is connected to the PCB 430 provided within the drive unit 400. Accordingly, when the shelf 300 is mounted, the controller 330 and the PCB 430 can be electrically connected.

Further, the PCB 430 is also connected through a power line L to the drive motor 422, and is connected to a main PCB 430 of the body 110 through a wall of the body 110, to be capable of supplying power and transmitting/receiving control signals.

The operation of a refrigerator configured as above according to the first embodiment of the present invention will be described below.

A user pivots a door 130 to store food, and opens a storage compartment inside the refrigerator. Here, if the food being stored is large in size, or if the user determines that the space inside the refrigerator needs adjustment, the shelf apparatus 200 is manipulated.

In order to move the shelf 300 of the shelf apparatus 200 and enlarge the space below the shelf 300, the up button 332 of the controller 330 on the shelf 300 is pressed to move the shelf 300 upward.

Through manipulation of the controller 330, the PCB 430 receives a control signal and drives the drive motor 422. The driving of the drive motor 422 rotates the pinion 424 forward, and the pinion 424 moves upward along the drive rack 450 by means of its gear engagement with the drive rack 450.

Specifically, the driving of the drive motor 422 rotates the pinion 424 to move the drive unit 400 upward, so that the shelf 300 mounted on the drive unit 400 is also moved upward. The shelf 300 continues to move upward until the hand that presses the up button 332 of the controller 330 is removed, and the shelf 300 stops when a user stops pressing the up button 332 at a desired position.

In order to move the shelf 300 of the shelf apparatus 200 downward and enlarge the space above the shelf 300, the down button 334 of the controller is pressed. When the down button 334 is pressed, the drive motor 422 operates to rotate the pinion 424 in reverse. Through the driving of the drive motor 422, the pinion 424 moves downward along the drive rack 450 by means of its gear engagement with the drive rack 450.

Then, after a user presses the down button 334 to move the drive unit 400 downward until a desired position is attained, the hand pressing the down button 334 is removed to stop the shelf 300. Accordingly, the drive unit 400 moves downward, and the shelf also moves downward to enable enlargement of the space above the shelf 300.

Also, the shelf 300 may be separated from the drive unit 400 if required. For this, a user first lifts the shelf 300 upward and then pulls it forward, whereupon the catch portion of the shelf 300 disengages from the retaining hole 442 of the mounting portion 440 and is removed.

A user can enlarge a portion of the storage space inside the refrigerator by removing the shelf 300, and washing of the shelf 300 is also facilitated.

In order to mount the shelf 300, the catch portion of the shelf 300 is inserted in the retaining hole 442 of the drive unit 400, and when mounting the shelf 300, the shelf power terminal 340 and the drive unit power terminal 460 are put into mutual contact to electrically connect the controller 330 and the PCB 430. Accordingly, after the shelf 300 has been mounted, moving the shelf upward and downward through a user's manipulation is made possible.

A refrigerator and a refrigerator shelf apparatus according to the present invention may be embodied in various other forms in addition to the embodiments described above, and a description of a refrigerator and refrigerator shelf apparatus according to the second embodiment of the present invention will be described below with reference to the drawings.

While a bottom freezer refrigerator is exemplarily used to describe a refrigerator and refrigerator shelf apparatus according to the second embodiment of the present invention for the sake of descriptive convenience and ease of understanding, the refrigerator shelf apparatus is applicable to any refrigerator provided with a shelf.

Figure 6:
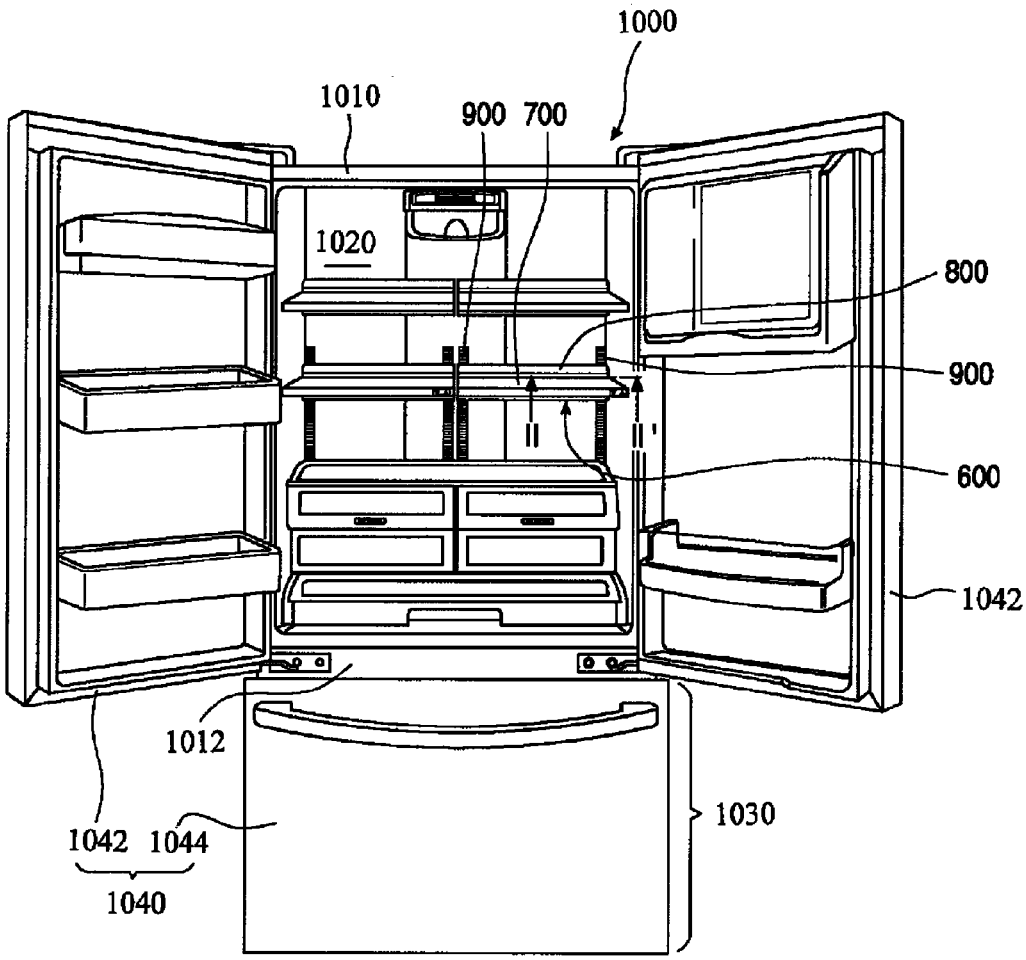
FIG. 6 is a frontal view of a refrigerator with doors open according to a second embodiment of the present invention.

FIG. 6 is a frontal view of a refrigerator with doors open according to a second embodiment of the present invention.

Referring to FIG. 6, a refrigerator 1000 according to the second embodiment of the present invention is configured with a body 1010 defining a storage space within, and a door 1040 mounted on the body 1010 to selectively open and close the storage space.

The storage space within the body 1010 is partitioned by a barrier 1012 and defined into a refrigeration compartment 1020 above and a freezer compartment 1030 below. Also, the door 1040 is configured as a refrigeration compartment door 1042 that is pivoted laterally to selectively open and close the refrigeration compartment 1020, and a freezer compartment door 1044 that is withdrawn and inserted forward and rearward in the manner of a drawer to selectively open and close the freezer compartment 1030.

A plurality of storage members such as shelves, drawers, and baskets is provided inside the refrigeration compartment and at the rear of the refrigeration compartment door 1042. Shelves and drawers of the storage members within the refrigeration compartment 1020 may be divided and arranged at the left and right sides, and may be installed symmetrically to the left and right about the inner center of the refrigeration compartment 1020.

Also, a portion of the shelves mounted within the refrigeration compartment 1020 may be selectively removable by a user, and may be cantilevered and configured to be adjustable to a desired height.

Also, a shelf apparatus 600 may be further provided inside the refrigeration compartment 1020 to be moved upward and downward through a user's manipulation while mounted on a shelf 700. At least one shelf apparatus 600 may be provided, may be provided at the left and right sides, respectively, as shown in FIG. 6, and may be provided vertically in succession at one of the left and right sides.

Figure 7:
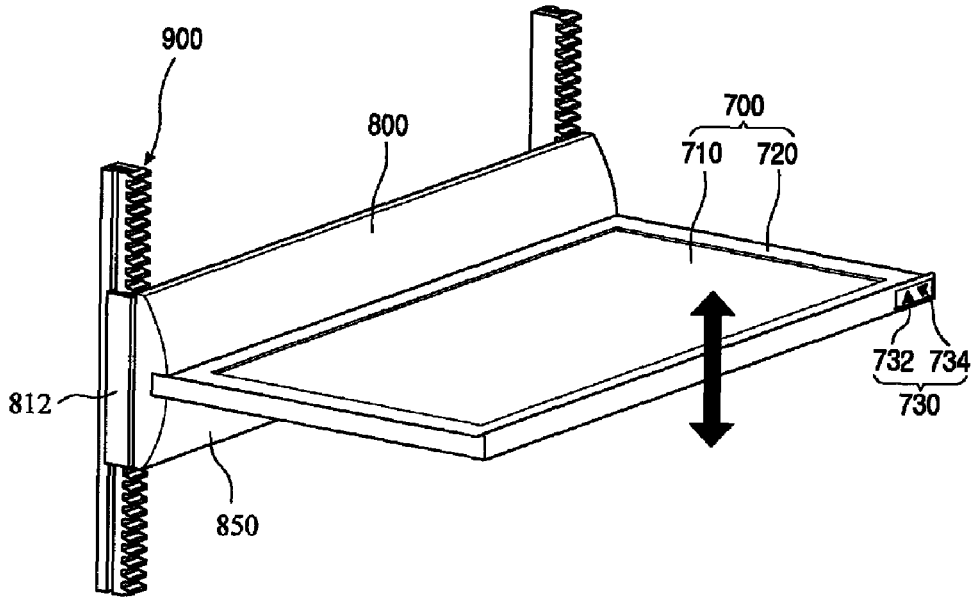
FIG. 7 is a perspective view of a refrigerator shelf apparatus according to the second embodiment of the present invention.
Figure 8:
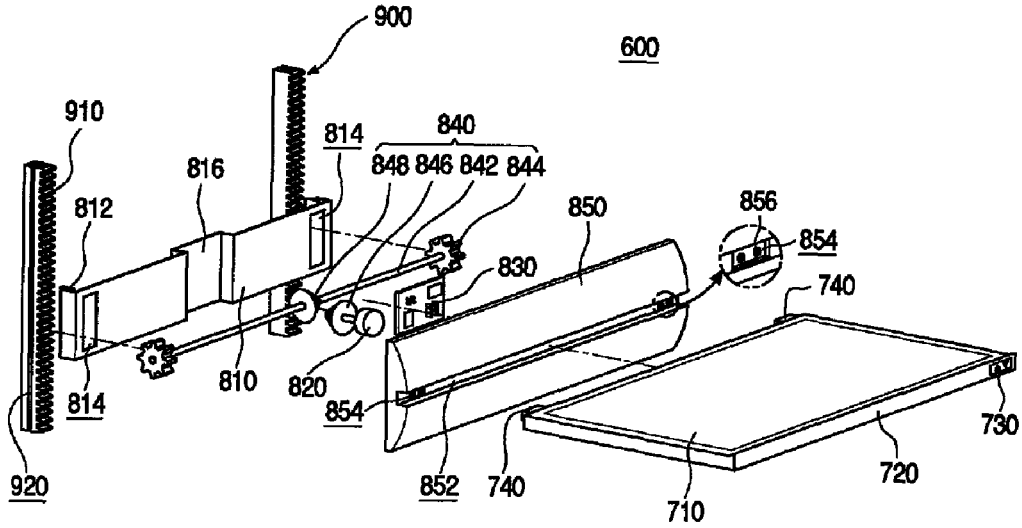
FIG. 8 is an exploded perspective view of a refrigerator shelf apparatus according to the second embodiment of the present invention.

FIG. 7 is a perspective view of a refrigerator shelf apparatus according to the second embodiment of the present invention, and FIG. 8 is an exploded perspective view of a refrigerator shelf apparatus according to the second embodiment of the present invention.

To describe the shelf apparatus 600 with reference to FIGS. 7 and 8, the shelf apparatus 600 is mounted on the rear wall within the refrigeration compartment 1020, and includes a shelf 700, a drive unit 800, and a guide member 900.

The shelf 700 is formed in a rectangular plate shape, and is configured with a plate 710 formed of tempered glass to provide a surface on which food is placed, and a frame 720 surrounding the perimeter of the plate 710. The shelf 700 may be formed by insert molding the plate 710 in the frame 720, or may be formed by forming the plate 810 and frame 720 as separate members and then coupling them, as required.

A controller 730 is formed on the front of the shelf 700. The controller 730 is for controlling the vertical movement of the shelf 700, and is provided with at least one button or more to determine the operation of a drive unit 800 (to be described below). In detail, the controller 730 is provided on one side at the front of the frame 720, and an up button 732 and a down button 734 are provided on the controller 730 for a user to manipulate when selecting an operation.

Also, an inserting portion 740 is formed on the rear end of the shelf 700. The inserting portion 740 is formed projecting rearward from the rear surface of the shelf 700, and is formed on both the left and right sides on the rear of the shelf 700.

The drive unit 800 moves upward and downward through manipulation of the controller 730, and is configured so that the shelf 700 can be fixed and mounted thereon. The drive unit 800 is configured to include a base plate 810, a drive motor 820, a PCB 830, a gear assembly 840, and a cover 850.

In detail, the base plate 810 forms the rear surface of the drive unit 800, and a guide portion 812 is formed on both the left and right sides of the base plate 810 to enable the guide unit 800 to be coupled to the guide member 900 while being capable of moving upward and downward.

Also, an open through-hole 814 is defined in both the left and right sides of the base plate 810 so that at least portions (coupled through gears to move relative to the guide member 900) can project outwardly therethrough. Also, a pinion portion 816 is defined projecting rearward at the approximate center of the base plate 810 to provide a space to accommodate bevel gears 746 and 748.

A drive motor 820 rotating forward or in reverse to generate rotational force through power supplied by the controller 730, and a PCB 830 that controls driving of the drive motor 820, are provided at the front of the base plate 810. The drive motor 820 and the PCB 830 may be fixed to the base plate 810 with separate members, and may be fixed and mounted to the inner surface of the cover 850.

Also, a gear assembly 840 is provided at the front of the base plate 810. The gear assembly 840 is configured to receive the driving force generated by the drive motor 820 and rotate. The gear assembly 840 is configured with a shaft 842 extending in an intersecting direction with the rotating shaft of the drive motor 820, a pinion 844 provided on either end of the shaft 842 and engaged through gears with the guide member 900 to rotate, a first bevel gear 846 installed on the rotating shaft of the drive motor 820 at the approximate center of the shaft 842, and a second bevel gear 848 perpendicularly engaged with the first bevel gear 846 to rotate the shaft 842.

The base plate 810 is coupled to a cover 850 at the front of the base plate 810. The cover 850 defines the front shape of the drive unit 800, and is formed to cover the inner components of the drive unit 800, including the gear assembly 840 and drive motor 820 in front of the base plate 810, and the PCB 830.

Also, a receiving portion 852 for receiving the rear of the shelf 700 is defined in the approximate center of the front surface of the drive unit 800. The receiving portion 852 is defined to correspond to the vertical thickness of the shelf 700 and have a predetermined depth enabling it to support the shelf 700 when the latter is inserted therein.

When an inserting portion 740 is formed at the rear end of the shelf 700, a retaining portion 854 is further defined to be recessed further rearward from both the left and right side of the receiving portion 852 to correspond to the inserting portions 740, so that the inserting portions 740 can be inserted therein.

Accordingly, when the shelf 700 is mounted, the receiving portion 852 and the retaining portion 854 of the cover 850 receive the rear end of the shelf 700 and the inserting portion 740, respectively, so that the shelf 700 can not only be maintained in a mounted state, but can be maintained in the mounted state when food is placed thereon.

In order to more firmly fix and mount the shelf 700, a permanent magnet may be disposed on the inserting portion 740 and the retaining portion 854, respectively, to press them together through magnetic force, and if required, the inserting portion 740 and the retaining portion 854 may be further provided with a means such as a hook, for selective form-coupling and separation.

Also, when mounting the shelf 700, the controller 730 of the shelf and the drive motor 820 of the drive unit 800 may be electrically connected, and for this end, a drive unit power terminal 856 may be provided within the retaining portion 854.

The guide member 900 is formed as a pair on the rear wall within the refrigerator. The guide member 900 is configured to mount the drive unit 800 and guide the upward and downward movement of the drive unit 800.

In detail, the guide member 900 is hollow within, and has a length corresponding to the range of vertical movement of the shelf 700. Also, the guide members 900 at both the left and right sides are disposed at a distance apart corresponding to the transverse length of the drive unit 800.

Further, a gear portion 910 such as a rack is formed extending vertically along the front surface of the guide member 900, and is configured to engage through gears with the pinion 844 so that the pinion 844 can move up and down by rotating.

Also, a guide slot 920 is defined in the outer surface of the guide member 900. Being a part through which a portion of the moving guide 812 inserted into the guide member 900 passes, the guide slot 920 is defined to extend from the top to bottom of the guide member 900, and enables the drive unit 800 to move vertically while in a mounted state.

Figure 9:
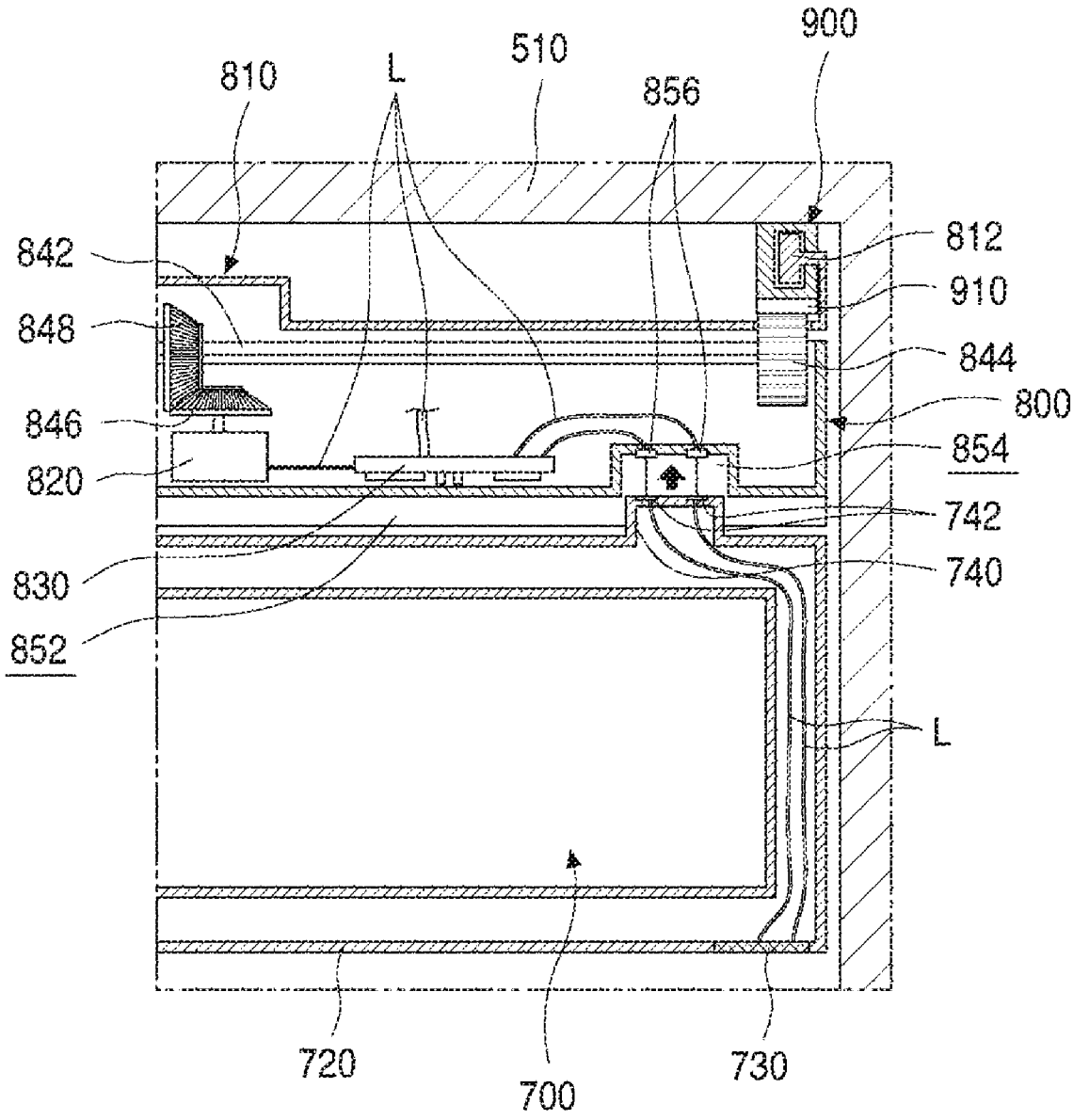
FIG. 9 is a partial sectional view of a refrigerator shelf apparatus according to the second embodiment of the present invention.

FIG. 9 is a partial sectional view of a refrigerator shelf apparatus according to the second embodiment of the present invention, showing a cross-section taken along line II-II' in FIG. 6.

Referring to FIG. 9, the moving guide 812 is bent inward at either end of the base plate 810, and has a portion thereof received in the guide member 900 and the remainder thereof disposed through the guide slot 920.

Accordingly, through being coupled with the moving guide 812, the drive unit 800 can be mounted on the guide member 900 to be capable of moving vertically. Also, at least a portion of the moving guide 812 may be formed of an engineering plastic material with good durability, wear resistance and lubricative properties. Also, a separate component such as a bearing or lubricating member may be provided between the inside of the guide member 900 and the moving guide to enable smooth vertical movement of the drive unit 800.

The controller 730 of the shelf 700 is connected to a shelf power terminal 742 provided at the rear of the inserting portion 740 through a power line. Also, a drive unit power terminal 856 is provided on the inner surface of the retaining portion 854 of the cover 850, and connected to the PCB 830 by a power line L.

The shelf power terminal 742 and the drive unit power terminal 856 may be formed at mutually facing positions, to be brought into mutual contact and be electrically connected when the shelf 700 is mounted.

Further, the PCB 830 is connected to the drive motor 820 by a power line L, and the PCB 830 is connected to a main PCB 830 of the body by a power line L, to enable it to receive electrical power and control signals for driving the drive motor 820.

A power line L proceeding from the PCB 830 to the main PCB 830 may pass through a wall inside the refrigerator and be guided along the guide member 900.

The operation of a refrigerator configured as above according to the second embodiment of the present invention will be described below.

In order to store food, a user pivots the refrigeration compartment door 1042 to open the storage space inside the refrigerator. Here, when food to be stored in the refrigerator is large in size, or when the user determines a need to adjust the space inside the refrigerator, the shelf apparatus 600 is manipulated.

In order to move the shelf 700 upward to enlarge the space below the shelf 700, the up button on the controller 730 provided on the shelf 700 is pressed to move the shelf 700 upward.

Through manipulation of the controller 730, the PCB 830 receives an input of a control signal and drives the drive motor 820. Through driving the drive motor 820, the first bevel gear 846 is rotated, and through rotation of the second bevel gear 848 coupled through gears to the first bevel gear 846, the shaft 842 is rotated. The rotation of the shaft 842 rotates the pinions 844 at either side of the shaft 842 in a forward direction, and through gear coupling with the guide member 900, the pinions 844 move upward along the guide member 900.

Specifically, the pinions 844 are rotated through the rotation of the bevel gears 746 and 748 driven by the drive motor 820, in order to move the drive unit 800 upward so that the shelf 700 mounted on the drive unit 800 is also moved upward. The shelf 700 continues upward movement until the hand pressing the up button 732 of the controller 730 is removed, and when a user removes his/her hand from the up button 732 when a desired position is attained, the shelf 700 comes to rest.

In order to move the shelf 700 downward and enlarge the space above the shelf 700, the down button 734 of the controller 730 is pressed. When the down button 734 is pressed, the drive motor 820 is driven to rotate the bevel gears 746 and 748 and the pinions 844 in reverse directions. Through driving the drive motor 820, the pinions 844 move downward along the guide member 900 through being gear-coupled to the guide member 900.

Also, after a user presses the down button 734 to move the drive unit 800 downward until a desired position is attained, the user removes his/her hand from the down button 734 to stop the shelf 700. Accordingly, the drive unit 800 moves downward, and the shelf 700 is also moved downward to enlarge the space above the shelf 700.

Further, the shelf 700 is removable from the drive unit 800 when required. For this, when a user pulls the shelf 700 forward, the inserting portion 740 of the shelf 700 is removed from the retaining portion 854 so that the rear of the shelf 700 disengages from the receiving portion 852 and the shelf can be separated from the drive unit 800.

By separating the shelf 700, a user can further enlarge a portion of the storage space within the refrigerator, and cleaning of the shelf 700 is also facilitated.

In order to mount the shelf 700, when the rear of the shelf 700 is inserted into the receiving portion 852, and the shelf 700 is pushed further rearward, the inserting portion 740 of the shelf 700 can be inserted into the retaining portion 854.

Through mounting the shelf 700, the shelf power terminal 742 and the drive unit power terminal 856 are brought into mutual contact, and the controller 730 and the PCB 830 are electrically connected. Accordingly, after the shelf 700 is mounted, the shelf 700 can be moved upward and downward through a user's manipulation.

What is claimed is:

1. A refrigerator, comprising:

a body including a cooling chamber; and a shelf assembly positioned in the cooling chamber, the shelf assembly including:

a shelf moveable in a vertical direction;

a pair of guide members positioned along the cooling chamber and fixed thereto;

a drive unit movable along the pair of guide members in the vertical direction, the drive unit including a shelf supporter to receive and position the shelf;

a controller switch located on the shelf and electrically connected to the drive unit to move the shelf supporter based on operation of the controller switch; and a grille pan defining a back side of the cooling chamber, the drive unit being provided behind the grille pan so as to be covered by the grille pan, wherein the shelf has a hook-shaped catch portion formed at a rear of the shelf so that the shelf is detachably mounted to the drive unit.

2. The refrigerator of claim 1, wherein the shelf supporter is a plate with respective ends positioned within the pair of guide members and movable along the pair of guide members from within.

3. The refrigerator of claim 2, wherein the shelf includes a plate and a frame forming the perimeter of the plate and fixable to the drive unit.

4. The refrigerator of claim 3, wherein the controller switch is electrically connected to the drive unit through the frame.

5. The refrigerator of claim 1, wherein the shelf assembly further includes a drive motor attached to a gear, the drive motor being activated by the controller switch.

6. The refrigerator of claim 5, wherein the shelf assembly further includes a base plate fixed to a rear surface of the grille pan and having a rack gear that engages the gear of the drive motor to raise or lower the drive unit and the shelf supporter based on the operation of the controller switch.

7. The refrigerator of claim 1, wherein the shelf supporter extends in a lengthwise direction of the drive unit and is formed to have a width that fits with a width of the shelf.

8. The refrigerator of claim 7, wherein the shelf includes a pair of catch portions that support the shelf, and the shelf supporter includes a pair of retaining holes to receive the pair of catch portions, the pair of retaining holes being respectively formed at ends of the shelf supporter.

9. The refrigerator of claim 8, wherein the controller switch is electrically connected to the drive unit through one of the pair of the retaining holes.

* * * * *